United States Patent [19]

MacArthur

[11] 4,369,087

[45] Jan. 18, 1983

[54] METHOD AND APPARATUS FOR MAKING PILE FABRICS

[75] Inventor: Dennis C. MacArthur, Kennesaw, Ga.

[73] Assignee: Amoco Chemicals Corporation, Chicago, Ill.

[21] Appl. No.: 211,956

[22] Filed: Dec. 1, 1980

[51] Int. Cl.[3] ..... D04H 11/08

[52] U.S. Cl. ..... 156/435; 28/159; 156/72; 156/204; 156/205; 156/469; 156/472; 156/473; 156/474; 156/549; 223/28; 270/39; 428/94; 428/96

[58] Field of Search ..... 156/72, 469, 204, 472, 156/205, 473, 210, 474, 227, 549, 435; 270/39; 223/28; 28/159; 428/94, 96

[56] References Cited

U.S. PATENT DOCUMENTS 1,914,962 6/1933 Smith ..... 156/204

3,542,625 11/1970 Vernier ..... 156/72

*Primary Examiner*—John J. Gallagher

*Attorney, Agent, or Firm*—Robert R. Cochran; William H. Magidson; William T. McClain

[57] ABSTRACT

A web is placed on a grooved cylinder, folded by pressing it into the cylinder grooves, and attached to a backing sheet to form a pile fabric. Folding is performed by rollers with blades which enter and move along the length of the grooves. The rollers are guided precisely by guide members on their opposite axial sides. To prevent the rollers from pushing the textile material across the grooved cylinder surface, the rollers are rotated independently of their contact with the web.

12 Claims, 2 Drawing Figures

METHOD AND APPARATUS FOR MAKING PILE FABRICS

BACKGROUND

This invention relates to a method and apparatus for forming pile fabrics by folding a textile web and bonding it to a backing sheet, such techniques being the general subject matter of patents classified in U.S. class 156, subclass 435.

More specifically, this invention is concerned with improvements to the method and apparatus disclosed by U.S. Pat. No. 3,542,625 which issued Nov. 24, 1970, to Andre Antoine Vernier. The entire disclosure of this earlier patent is, by reference, incorporated into this specification. In such machines, a web is laid on a grooved support member, typically a cylinder, and the web is folded into the cylinder grooves by means of rollers which move across the cylinder parallel to the grooves, such rollers being provided with blades which press the web downwardly into the grooves.

Two shortcomings of the Vernier system, which never became commercial, were that the folding rollers were not guided with sufficient precision to provide satisfactory results, and the rollers tended to push the web across the grooved cylinder surface, thereby distorting the configuration of the final product.

SUMMARY OF THE INVENTION

According to the present invention, the folding rollers are guided more accurately than in the Vernier system, and the rollers do not push the textile material laterally across the cylinder or other grooved support member.

The system which has improved roller guiding characteristics includes a movable support member which has a surface provided with a plurality of grooves. Textile material is fed onto the grooved surface, and a plurality of rollers are provided for folding the textile material. Each of these rollers has a central rotational axis and at least one peripheral blade. The rollers are moved in a path which has a portion lying parallel to the grooved surface of the support member so that the blades enter and move along the grooves to fold the textile material into the grooves. Two parallel guides are located on opposite axial sides of the rollers to guide precisely the position of the rollers relative to the grooved surface while the textile material is being folded. Finally, as is conventional, the folded textile material is attached to a backing sheet, preferably by adhesive bonding.

The system which avoids any pushing of the textile material by the rollers during the folding step also has the movable support member, textile feeding, and folding rollers such as those described above. Additionally, the folding rollers are given a rotational movement, independently of their contact with the textile material, so they do not push the textile material across the grooved surface of the support member. Preferably, the rollers are rotated by a friction member which is stationary in the direction of the roller path and is in engagement with the advancing rollers to provide roller rotation. The friction member may be a laterally displaceable member positioned in the path of the roller blades, and/or it may be positioned to engage a circular friction-driven surface which is on the roller, spaced from the folding blades. The rollers may be given their rotational movement continuously, just before they arrive at the grooved support member and/or during their movement across the grooved support member. A linear guide may be provided to perform the dual functions of holding the roller against the friction member and guiding precisely the position of the rollers relative to the grooved surface of the support member.

Although the invention may take many forms, the best mode presently contemplated by the inventor is disclosed in the following drawings and description.

DESCRIPTION OF A PREFERRED EMBODIMENT

Figure 1:
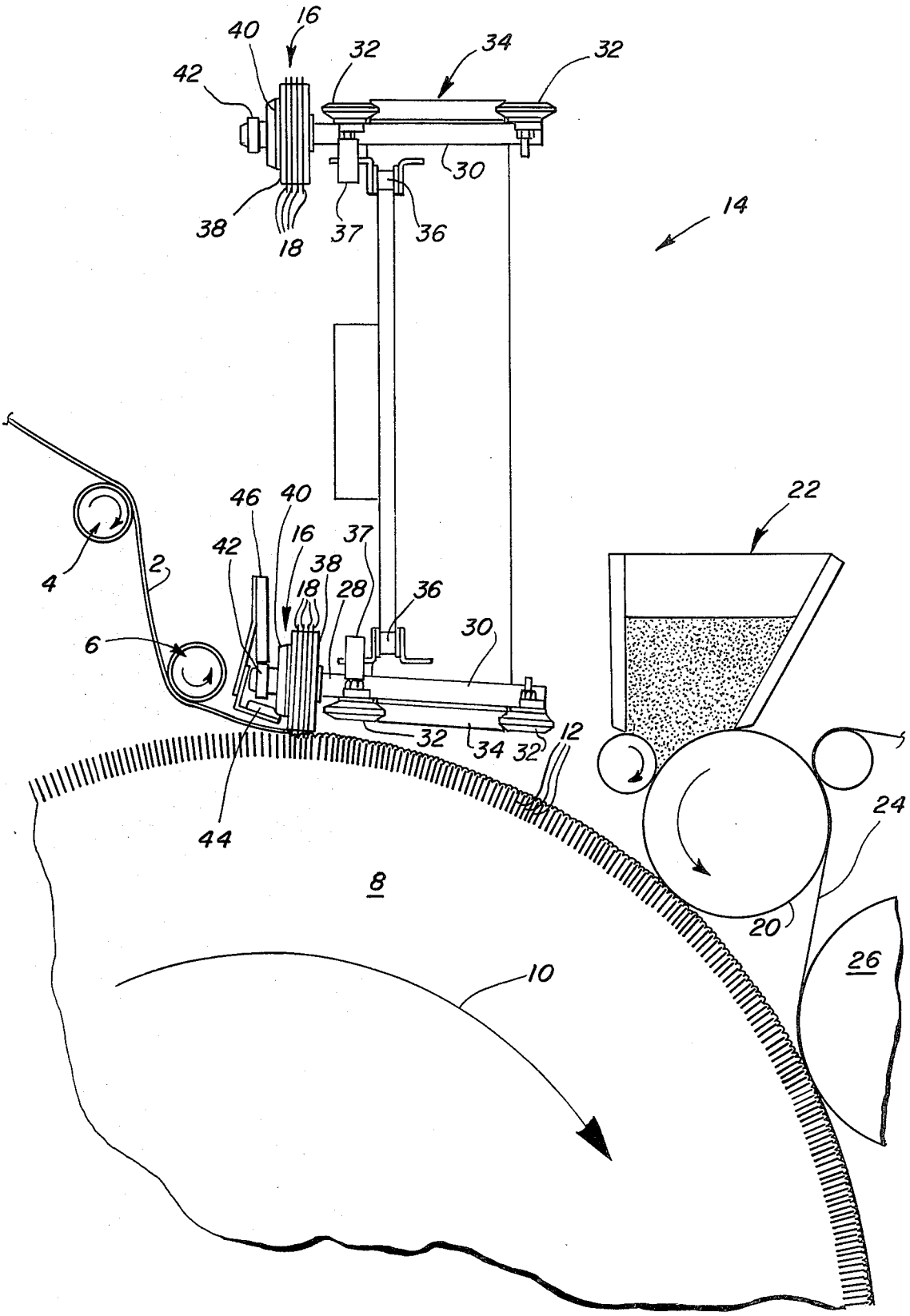
FIG. 1 is an elevational view of a preferred embodiment of the invention, taken transversely of the machine direction.

As shown in FIG. 1, a web 2 is fed by rolls 4 and 6 onto the surface of a cylindrical support member 8. The cylinder 8 is driven in the direction shown by arrow 10 and it has a plurality of thin blades 12 which lie in radial planes and extend parallel to the central rotational axis of the cylinder. These blades 12 provide the circumference of the cylinder 8 with a plurality of axially oriented grooves into which the web 2 may be folded.

A web 2 having an approximate width of seven feet is suitable, such a web being formed by simultaneously feeding and crosslapping six cards, each of which has a width of five feet.

The web 2 is folded into the cylinder grooves by a folding head 14 which is provided with a set of folding rollers 16. These rollers 16 have circumferential blades 18 which press the web 2 into the grooves of the cylinder 8, forming the web into loops which are subsequently attached to a backing sheet to form a loop pile carpet. The speed and direction of roller movement during folding is synchronized with the tangential velocity of the cylinder 8 so that the blades 18 will enter and move along the grooves to fold the web 2 into the grooves. Small grooves in the confronting faces of the blades 12 have been found to enhance the ability of the grooves to hold the folded web in position.

After the web is folded, an adhesive is applied to the exposed loop tips by an applicator roll 20. The adhesive is supplied to the roll 20 by a reservoir 22. A sheet of backing fabric 24 passes first over the adhesive applicator roll 20 where it receives any residual adhesive on the roll 20, and then into contact with the folded web where bonding pressure is applied by a compression roll 26. The product is removed from the cylinder 8 for finishing and, when finished, it has an appearance resembling that of a tufted loop pile carpet.

Two important characteristics of the disclosed machine are (a) the folding rollers 16 are given a rotational movement to prevent them from pushing the web 2 across the grooved surface of the cylinder 8, and (b) the folding rollers 16 are guided on their opposite axial sides to position them precisely relative to the grooved cylinder surface.

According to the preferred embodiment, each folding roller 16 is carried by and is rotatable on a shaft 28 which projects laterally from a carriage 30. The shaft 28 is skewed slightly relative to the path of carriage movement so that, during folding, the rotational axis of the roller will be perpendicular to the blades 12 and the cylinder grooves. Each carriage 30 has four guide wheels 32 which mate with and ride in opposed V-grooves on an oval trackway 34. The lower run of the trackway is substantially parallel to the peripheral surface of the cylinder 8, and it is skewed slightly forwardly in the direction of cylinder movement to enable the rollers to maintain an accurate track relative to the cylinder grooves. The carriages are driven along the trackway 34 by a drive chain 36 which is connected to lugs 37 on the carriages 30. The chain 36 is driven by a system which includes an electric motor, reduction gearing and a drive sprocket meshed with the chain 36.

Each of the rollers 16 has a main body 38 from which the folding blades 18 extend, a circular driven rim 40, and a circular guided rim 42 which has a smaller diameter than the rim 40. The components 38, 40 and 42 are joined together for concurrent rotation.

The preferred mechanism for rotating the rollers 16 is a stationary elongated friction member 44. This member preferably comprises a stiff metal base with a friction material such as compressible leather or foam riveted or bonded to its upper surface. As shown in FIG. 1, this member 44 is in frictional engagement with the driven rim 40 of the folding roller 16.

In order to guide the roller accurately, and to hold the driven rim 40 of the roller in frictional engagement with the member 44, a linear guide bar 46 is provided. This guide bar 46 lies parallel to the friction member 44 and parallel to the lower run of the trackway 34. As shown in FIG. 1, the guide bar 46 engages the upper portion of the guided rim 42 of the roller. This guiding action, coupled with the guiding function performed by the trackway 34 on the opposite axial side of the roller 16, precisely guides the position of the rollers relative to the grooved surface of the web-supporting cylinder 8, thereby preventing undesirable fluctuations in the depth to which the roller blades 12 penetrate the grooves of cylinder 8. The guide bar 46, as mentioned above, also acts downwardly on the roller so that its driven surface 40 is forcibly held in frictional engagement with the member 44. To reduce the tendency of the guide bar 46 to produce counterrotating forces, it is desirable to form or coat it with a low friction material such as Telfon polytetrofluroethylene polymers. Also, because the guided rim 42 has a smaller diameter than the driven rim 40, the predominant rotating forces will be in the preferred forward-rolling direction.

Figure 2:
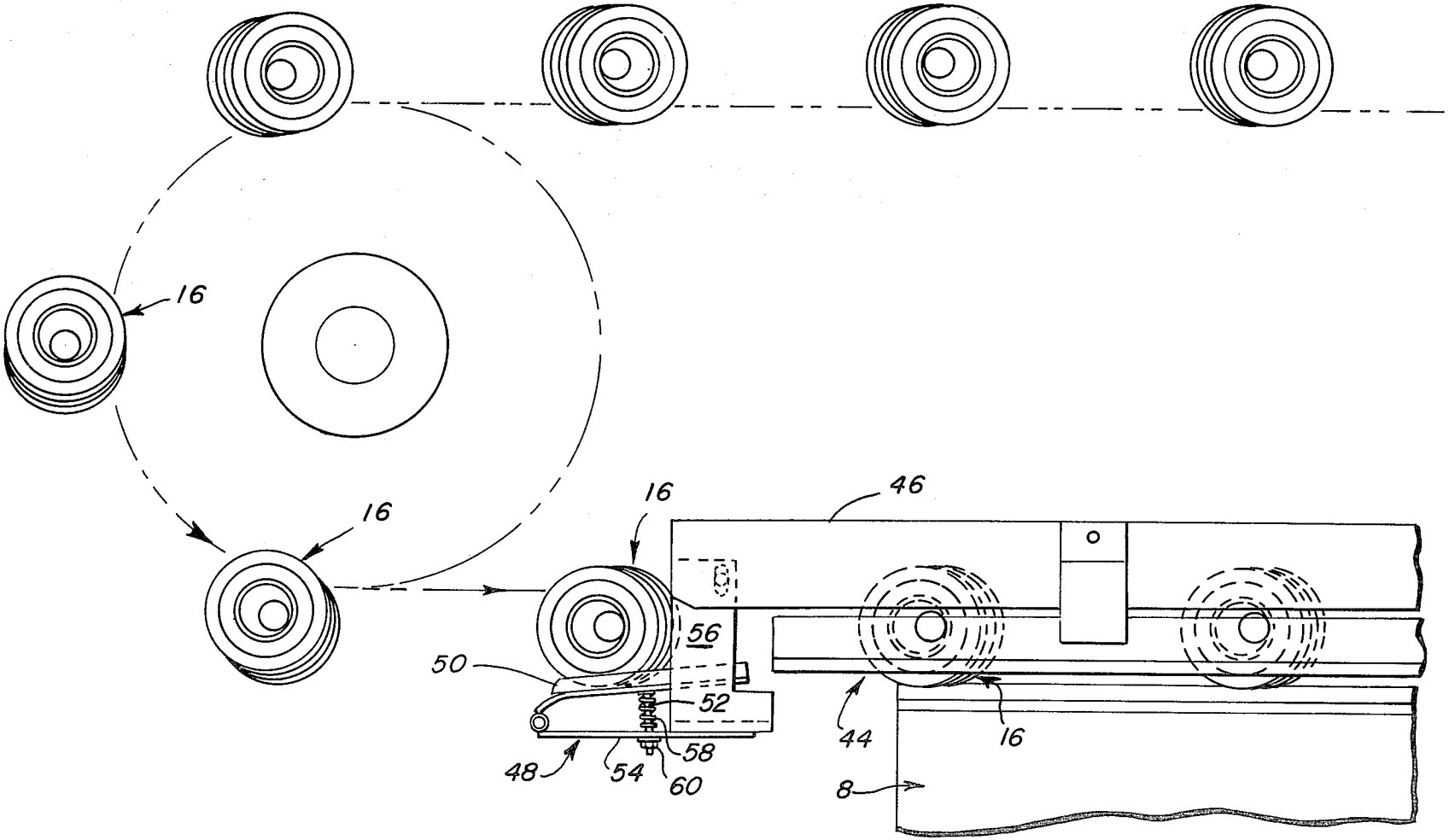
FIG. 2 is an elevational view taken longitudinally of the machine direction.

The preferred apparatus also has a mechanism for starting the rotation of the folding rollers 16 before they arrive at the friction member 44 and cylinder 8. This rotation starter is shown at 48 in FIG. 2. It includes a friction member 50 formed of a rigid backing plate covered with a high friction material such as leather. This member 50, like friction member 44, is stationary in the direction of the path of the rollers 16. However, the rotation-starting friction member 50 engages the roller blades 18 and it is capable of moving laterally, radially to the roller axes, when it is contacted by the roller blades 18. Such lateral movement is made possible by providing the member 50 with studs 52 which project loosely through holes in a plate 54 on a bracket 56. Compression springs 58 bias the member 50 upwardly into the path of the oncoming rollers 16, but the extent of such upward movement is limited by nuts 60 on the studs 52. These nuts 60 normally bear against the lower surface of plate 54. When a roller 16 strikes and rides up on the member 50, a forward rotational motion is given to the roller 16, and the member 50 is displaced downwardly while remaining in contact with the roller 16 due to the action of springs 58. As the roller progresses along its guided path, it rotates briefly with a freewheeling motion which continues until it arrives at the friction member 44.

The operation of the apparatus is evident from the foregoing description. The textile web 2 is fed to the circumference of the grooved cylinder 8 which acts as a support member for the web. The carriages 30 are driven along the trackway 34 by chain 36, moving the folding rollers 16 first to the rotation starter 48 where they are given an initial rotational movement due to the frictional contact between the member 50 and the blades 12 of the rollers 16. The rollers 16, while continuing to rotate, move on to the friction member 44 and cylinder 8. When the rollers 16 initially contact the textile web 2, they are rotating so as to prevent them from pushing the web 2 across the grooved surface of the support cylinder 8. As the rollers 16 continue their movement across the cylinder 8 and the web 2, their blades 12 fold the web into the cylinder grooves, the rollers being accurately guided on one axial side by the guide bar 46 and on the other axial side by the lower run of the trackway 34. Also, the rollers 16 are rotated during the folding step by the action of the elongated friction member 44 against the driven rim 40. This, too, prevents the rollers from pushing the textile material across the grooved surface of the cylinder 8.

The folded web 2 then has adhesive applied by roll 20 to the exposed tips of the loops, the backing fabric 24 is pressed thereagainst by the compression roll 26, and the product is passed on for conventional finishing procedures.

Persons familiar with the field of the invention will recognize that this disclosure is only an example of many possible variants. The web support member may be a grooved belt rather than a cylinder, and the folded material may be parallel yarns rather than carded webs. The rollers, their guides and the rotation-imparting devices may be used independently of each other and may take many forms in addition to those shown here. Accordingly, it is emphasized that the invention is not limited to the disclosed embodiment but is embracing of modifications and improvements which fall within the spirit of the following claims.

We claim:

1. In an apparatus for making pile fabrics, comprising a movable support member which has a surface provided with a plurality of groves, means for feeding textile material onto the grooved surface of the support member, a plurality of rollers for folding the textile material, each of said rollers having at least one peripheral blade and a central axis of rotation, means for carrying the rollers in a path which has a portion parallel to the grooved surface of the support member wherein the blades enter and move along the grooves to fold the textile material into the grooves, and means for attaching the folded material to a backing sheet, the improvement comprising means independent of the textile material for rotating the rollers as they move along said path to prevent the rollers from pushing the textile material across the grooved surface of the support member.

2. The apparatus of claim 1 wherein the means for rotating the rollers is a friction member which engages and rotates the rollers, said friction member being stationary in the direction of the path of the rollers.

3. The apparatus of claim 2 wherein the rollers have circular surfaces which are spaced from the blades, said friction member being frictionally engaged with said circular surfaces of the rollers.

4. The apparatus of claim 2 wherein the friction member is positioned where it engages the rollers before they arrive at the grooved support member, whereby the rollers will be rotating when they initially contact the textile material.

5. The apparatus of claim 2 wherein the friction member is positioned where it engages the rollers while they move across the grooved support member.

6. The apparatus of claim 2 or claim 4 wherein the friction member is movable in a direction which is radial to the axis of the rollers engaged thereby, and means for biasing the friction member toward the rollers.

7. The apparatus of claim 2 or claim 5 wherein the friction member is stationary in the direction of the path of the rollers, said apparatus having a linear guide means for holding the roller against the friction member.

8. The apparatus of claim 7 wherein the linear guide means has a low friction surface which is in contact with a rotating portion of the roller.

9. The apparatus of claim 8 wherein the portion of the roller contacted by the linear guide means has a smaller diameter than the portion of the roller engaged by the friction member.

10. In an apparatus for making pile fabrics, comprising, a movable support member which has a surface provided with a plurality of grooves, means for feeding textile material into the grooved surface of the support member, a plurality of rollers for folding the textile material, each of said rollers having at least one peripheral blade and a central rotational axis, means for moving the rollers in a path which has a portion parallel to the grooved surface of the support member wherein the blades enter and move along the grooves to fold the textile material into the grooves, and means for attaching the folded material to a backing sheet, the improvement comprising two parallel guide means located on opposite axial sides of the rollers for guiding precisely the position of the rollers relative to the grooved support of the support member while the textile material is being folded.

11. The apparatus of claim 10 having a plurality of movable carriages which carry the rollers along said path, a track which supports and guides the carriages, said track comprising one of said guide means.

12. The apparatus of claim 11 wherein the other of the guide means is a linear bar which is parallel to the grooved surface of the support member, said apparatus further having a linear friction member which is parallel to the linear bar and is on the opposite side of the roller axis than the track, said friction member being engaged with the rollers to rotate the rollers to prevent the rollers from pushing the textile material across the grooved surface of the support member.

* * * * *